US006478455B2

(12) United States Patent
Ahroni

(10) Patent No.: US 6,478,455 B2
(45) Date of Patent: Nov. 12, 2002

(54) DECORATIVE LIGHTING APPARATUS

(76) Inventor: Joseph M. Ahroni, 2701 W. Manor Pl., No. 204, Seattle, WA (US) 98121

( * ) Notice: Subject to any disclaimer, the term of this patent is extended or adjusted under 35 U.S.C. 154(b) by 0 days.

(21) Appl. No.: 09/747,306

(22) Filed: Dec. 22, 2000

(65) Prior Publication Data

US 2002/0080609 A1 Jun. 27, 2002

(51) Int. Cl.[7] ..... F21S 4/00

(52) U.S. Cl. ..... 362/352; 362/249; 362/123; 362/806; 362/391; 362/396

(58) Field of Search ..... 362/252, 249, 362/123, 391, 396, 806

(56) References Cited

U.S. PATENT DOCUMENTS 5,893,628 A * 4/1999 Byers ..... 362/145
6,070,991 A * 6/2000 Rumpel ..... 362/249
6,155,697 A * 12/2000 Ahroni ..... 362/252

* cited by examiner

*Primary Examiner*—Sandra O'Shea
*Assistant Examiner*—Mark Tsidulko
(74) *Attorney, Agent, or Firm*—Seed IP Law Group PLLC

(57) ABSTRACT

A unitary frame having a design simulating a magnified snowflake holds a string of lights mounted on a cord gripped in upstand channels presented by the frame between the lights on the string.

27 Claims, 5 Drawing Sheets

DECORATIVE LIGHTING APPARATUS

TECHNICAL FIELD

The present invention relates to decorative lighting units of the type in which a string of lights is mounted on one or more support frames to achieve a predetermined lighting design.

BACKGROUND OF THE INVENTION

In the past, wire frames have been used for holding lights on a lighting string to form an outline of an object, such as a Christmas tree. The present invention provides an improved light display system and frame for holding a light string, such that the lights present a design simulating a magnified snowflake.

SUMMARY OF THE INVENTION

In carrying out the invention, an injection-molded plastic frame is provided, having a plurality of flat spokes radiating integrally from a hub and each having several coplanar branches extending therefrom. The spokes and branches are provided with upstanding channels for receiving and holding a two-wire cord on which a series of miniature light units are mounted in series. The cord is gripped by the channels with the light units laying flat against the frame. For ease of assembly, the light units are equally spaced apart along the cord. Each branch holds a light unit and in addition a light unit is positioned between the root ends of the spokes. Multiple of the frames may be suspended or otherwise mounted in an array.

DETAILED DESCRIPTION OF THE INVENTION

Figure 8:
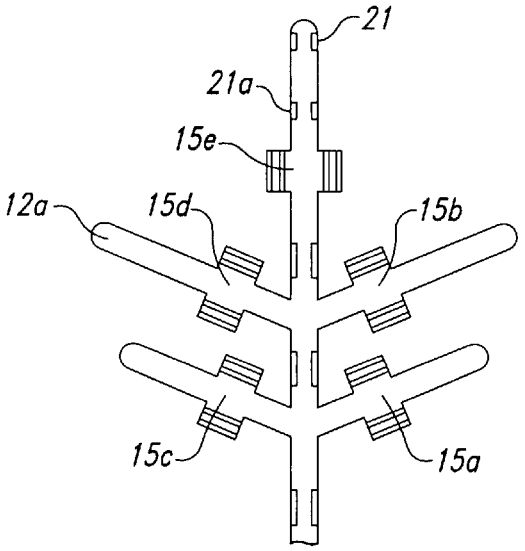
FIG. 8 is a front elevational view showing the tip branch at the entry to the frame of the snowflake unit.

Referring to the drawings, it is seen that one or more snowflake units 10 are provided which are lighted by a string of light units 11. Each snowflake unit has an injection molded, unitary backing frame 12 on which the light string is mounted. The backing frame 12 has a flat back side and each is formed with a hexagonal hub 13 with radiating spokes 14 from which a respective group of two right side branches 15*a–b*, two left side branches 15*c–d*, and a tip branch 15*e* extend. Each of these branches 15*a–e* has a pair of branch channels 16*a–b* about midway along their length. These branch channels 16*a–b* are complemented by an outer spoke channel 17 near the inner end of the tip branch 15*e*, a central spoke channel 18 on each spoke between the root ends of the branches 15*a*, 15*c* and branches 15*b*, 15*d*, and an inner spoke channel 19 between the inner branches 15*a*, 15*c* and the hub 13. Adjacent each intersection of the hub and one of the spokes 14 a generally Y-shaped channel 20 is provided having two diverging sections 20*a*, 20*b* spacing radially outwardly slightly from the hub 13, and having a third outwardly radiating section 20*c* projecting from the spoke. One of the tip branches 15*e* is formed with a pair of guides 21, 21*a* (FIG. 8) for leading in a two-wire cord 27 supplying power to the snowflake lights.

The light units 11 can be of the push-in type shown, for example, in U.S. Pat. Nos. 4,631,650 and 4,779,177, and 5,154,508, but having two rather than three wires in the cord. More specifically, the light units 11 may be, for example, of the type including an injection-molded two-piece plastic lampholder consisting of a socket unit 22 and a generally U-shaped base unit 23 which have a snap interfit and provide therebetween a wireway 31 for passage of a cord 27 containing an interrupted active wire 27*a* and a return wire 27*b*. The socket unit 22 provides a generally circular socket cavity 22*a* along the length for receiving a push-in bulb unit 24 having an injection-molded plastic bulb holder 25 in which a bulb 26 with a pair of leads 26*a* from its filaments is mounted. Each lampholder also has a pair of elongated push-in contact elements 28 located in guideways at opposite sides of the socket cavity 22*a* and arranged to project into the wireway 31. There the contact elements 28 pierce the insulation 27*c* of the cord 27 so as to engage the wire 27*a* of the cord on opposite sides of a respective cutout 27*d* in the wire.

Projecting from the socket unit 22 on opposite sides of the wireway 31 are two locking legs 32 presenting opposed locking shoulders 32*a* adjacent their outer end for interfitting with the base unit 23. These shoulders 32*a* are adjoined by beveled lead-in faces 32*b*. The inner face of each locking leg 32 is transversely concave matching the curvature of the socket cavity 22*a*.

The base unit 23 has a pair of flexible guide fingers 34 shaped to engage the lead-in faces 32*b* and be flexed at their root end toward one another responsive to pushing of the base unit 23 and socket housing 22 together from opposite sides of the cord 27 after the base unit 23 has been positioned with the cord 27 straddled by the fingers 34 at the site of the cutout 27*d*. At their root end the fingers 34 have retaining shoulders 35 between curved base flanges 36. These shoulders 35 are engaged by the locking shoulders 32*a* when the base unit 23 and socket unit 22 are snap-fitted together over the cord 27. As a result, the cord 27 is firmly gripped between the base unit 23 and socket unit 22. The guide fingers are preferably arched transversely to provide each with a convex outer guide face 34*a* complementing the concave inner guide face of the respective locking leg 32, and the free end of each guide finger 34 is preferably rounded and beveled on its convex outer side as indicated at 34*b*. The base unit 23 presents a post 37 arranged between the fingers 34 to project into the cutout 27*d* in active wire 27*a* of the cord 27.

The bulb holder 25 has a central socket 40 to receive the bulb 26. This socket 40 is provided in a round plug 42 having an outwardly flared annular rim 43 spaced above its lower end, and having a relatively narrow extension 44 with opposite exterior flat side faces 44*a* between narrow pinch faces 44*b*. A pair of longitudinal passages (not shown)

extend through the base of the plug 42 and through the length of the extension 44 into a slot 47 located at the free end of the narrow extension and intersecting the narrow faces 44*b*. These narrow faces 44*b* are spaced apart slightly less than the diameter of the socket cavity 22*a* to allow for the bulb leads 26*a* and are aligned with the bottom of positioning grooves 48 which are formed in the plug 42 and extend to an annular shoulder 49 at the base of the flared rim 43. When the bulb 26 is positioned in the bulb holder 25, the lead wires 26*a* extend from the bulb 26 through the passages 46 and outwardly at opposite ends of the slot 47. Then the leads 26*a* double back over the narrow pinch faces 44*b* and part way into the grooves 48. When the bulb unit 24 is pushed into the socket unit 22 the bulb leads 26*a* are pinched between the pinch faces 44*b* and the contact elements 28 to complete a circuit bypassing the respective cutout 27*d* in the wire 27*a*.

The bulb holder 25 preferably is provided with a locking finger 50 which projects from the annular rim 43 and has an inturned locking element 50*a* which is tapered at its bottom side. The locking finger is arranged to spring outwardly as it rides over a sloped entry ramp 51 on the socket housing 22 when the bulb holder 25 is pushed into the cavity 22*a*. Then the locking finger 50 springs inwardly at the outer end of the ramp 51 so that the locking element 50*a* engages a stop shoulder beneath the ramp. The locking finger 50 has a pair of fork arms 50*b* which connect to the rim 43 of the bulb holder 25 and are separated by an opening 50*c* which overlies the locking element 50*a*. This arrangement makes it possible to injection mold the locking finger as an integral part of the bulb holder 25.

The cord 27 enters the frame through the guides 21 and passes along the tip branch between its channels 16*a*, 16*b*. Then it doubles back at 27*b* through the right channel 16*a* of the tip branch to enter the wireway of the first light unit 11*a*. It leaves the first light unit and passes through the left channel 16*b* of the tip branch and outer channel 17 of the respective spoke 14. Then the cord passes outward through the left channel of the outer left branch 15*d*, through the wireway of the next light unit, and inward through the left channel 16*b* of the outer left branch.

Next, the cord passes through the central channel 18 of the spoke and outward through the right channel of the inner left branch 15*c* to the wireway of the next light unit. After passing through that wireway it returns to the spoke through the left channel of the inner left branch 15*c* to the inner channel 19 of the spoke. The cord then is guided by the Y-channel 20' to pass counterclockwise through the wireway of the next light unit to commence passage to the next spoke where it passes outwardly to the light units at the outer ends of the right lateral branches 15*a*–15*b*, then to the light unit on the tip branch 15*e*, and then passes inwardly to the light units at the outer ends of the left lateral branches 15*d*, 15*c* to return to the inner end of the respective spokes. It will be noted that each of the three spoke channels 17–19 contain portions of the cord passing outwardly away from the hub and also contain portions of the cord passing inwardly toward the hub. All of the channels are sufficiently resilient to grip the portions of the cord being guided by the channels.

Figure 1:
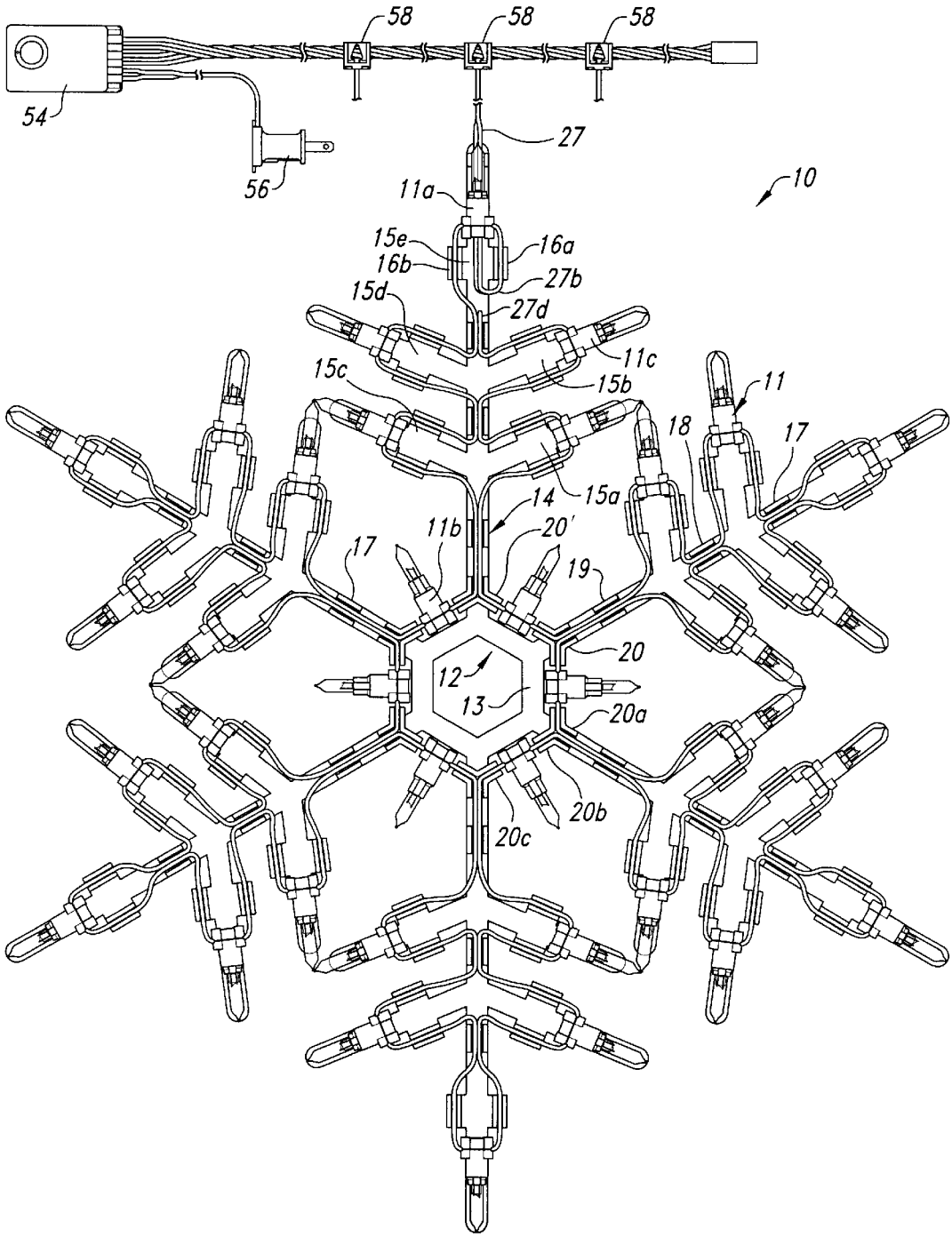
FIG. 1 is a front elevational view of a snowflake unit with lights in place made in accordance with the present invention.
Figure 2:
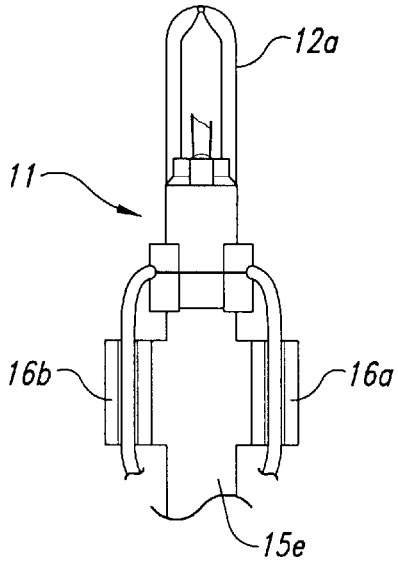
FIG. 2 is a fragmentary front elevational view to an enlarged scale showing the mounting of a light unit at the top of a branch of the snowflake unit.
Figure 3:
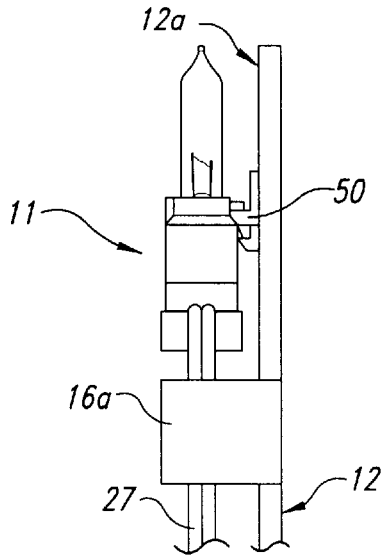
FIG. 3 is a side view of the structure shown in FIG. 2.
Figure 4:
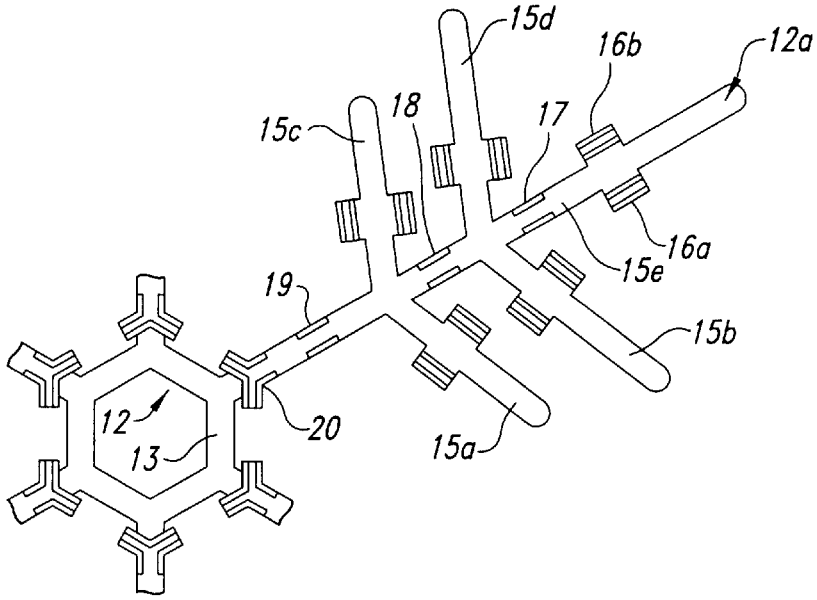
FIG. 4 is a fragmentary back elevational view of the frame of the snowflake unit.

Each of the branches has a flat tip portion 12*a* located behind the respective light unit and this is normally engaged by the outer face of the respective locking finger 50 to assist in properly positioning the light unit. Preferably the tip portion 12*a* extends longitudinally outward sufficiently to act as a back guard for the bulb in the respective light unit as shown in FIG. 3.

Preferably the light units are equally spaced along the cord in each frame. This simplifies production of the light strings and the mounting thereof on the frames.

Figure 7:
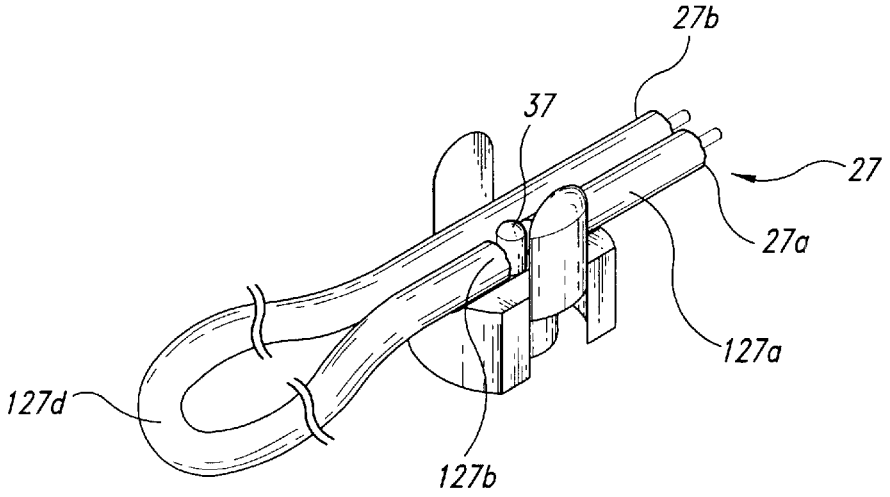
FIG. 7 is a perspective view of the base of the terminal light unit with the wiring in place.

The cord 27 is longitudinally split along the center of its insulation adjacent the terminal light unit 11*c* which is mounted on the right outer branch of the spoke at which the cord entered the frame and the interrupted active wire 27*a* is cut so that the return wire 27*b* is longer. The return wire 27*b*, after passing through the wireway of the terminal light unit 11*c*, is doubled back at a loop 127*d* and passed into the wireway to the end by a terminal portion 127*b* at the post 37. Wire 27*a* ends in the wireway by a terminal portion 127*a* at the opposite side of the post as shown in FIG. 7. These terminal portions 127*b* and 127*a* of the return wire and active wire are engaged by the contact elements 28 to complete a circuit to the bulb in the terminal light unit 11*c*.

Figure 5:
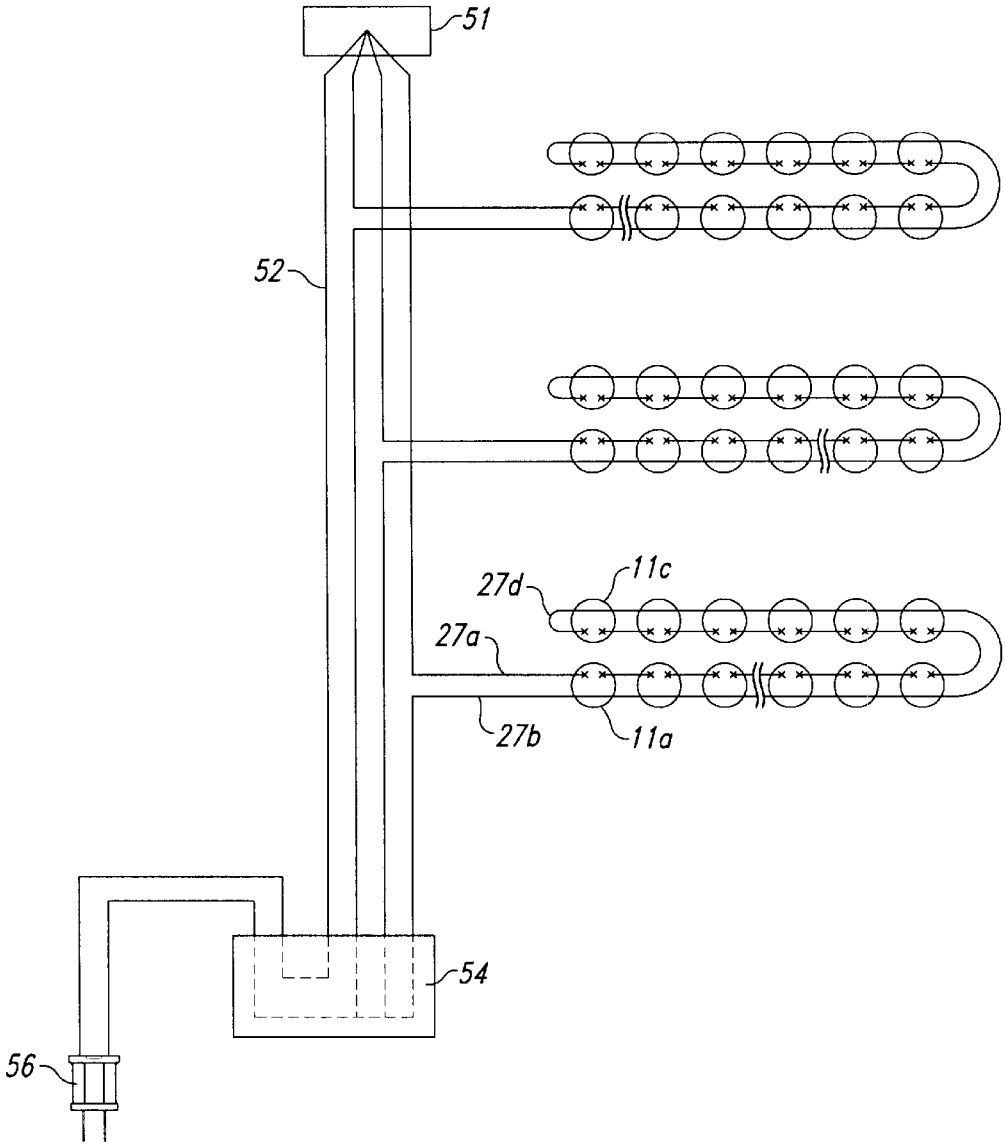
FIG. 5 is a schematic of the wiring for an array of three of the snowflake units.

As indicated in FIG. 5, three, for example, of the frames may be arranged in a side-by-side array in which case the wiring circuit can include a cord for each frame with the three return wires from the frames being connected at an end connector 51 with a ground wire 52 extending from a controller 54 or a wall plug 56, and with the three active wires extending to the controller or the wall plug. This arrangement provides a parallel-type circuit. The wires may be twisted together between clips 58 having a through passage intersected by a lateral passage as shown, for example, in U.S. Pat. No. 6,142,429. Each clip is positioned to receive the cord 27 for a respective frame into its lateral passage with its return and active wires separated by splitting the cord longitudinally and extending the resulting split portions of the cord oppositely in its through passage. When three frames 10 are used, each clip has three through wires entering and exiting from its through passage. One of these wires is the ground wire 52 from the controller 54 to the end connector 50 and the other two are through wires for the other two frames. In addition, a fourth wire appears to extend from each end of the through passage of the clip, whereas this fourth wire is actually the wires 27*a*–*b* in the cord 27 which extend into the through passage by way of the lateral passage in the clip and extend in opposite directions from the through passage. The clips 58 may be provided with hangers or openings to receive fasteners for mounting the clips so that the frames 10 can be suspended in generally side-by-side relation. Alternatively, the frames can be, for example, suspended one above another.

Figure 5A:
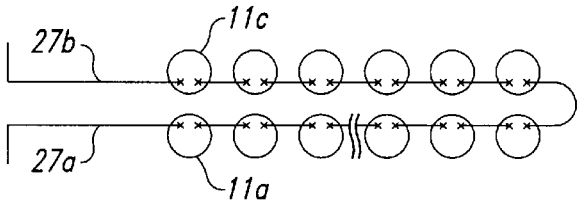
FIG. 5A is a schematic of an alternative wiring arrangement.
Figure 6:
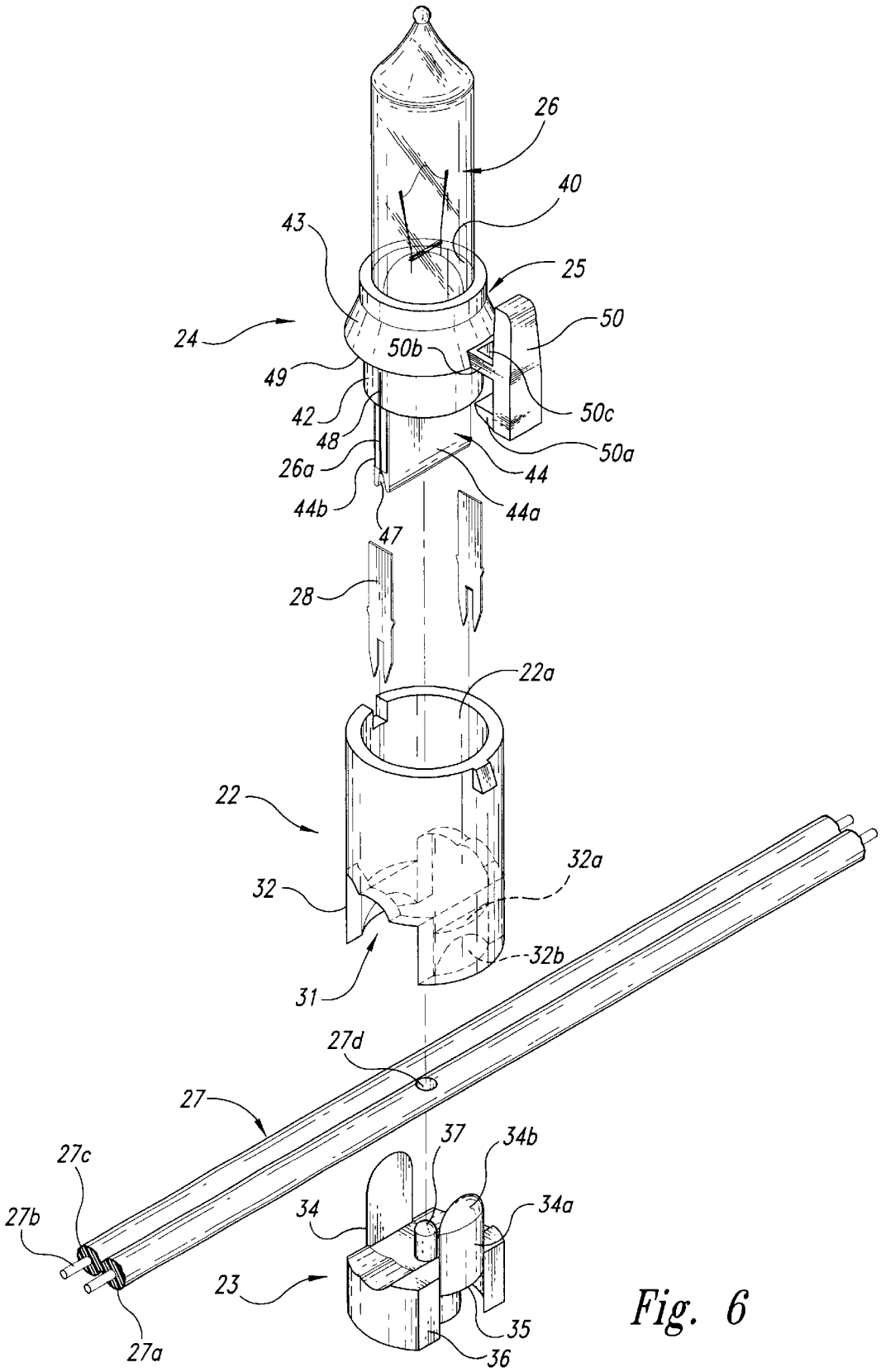
FIG. 6 is an exploded view of one of the light units.

As indicated schematically in FIG. 5A, the return wire 27*b* need not pass through the wireways of the light units, although it is preferred that they do so in order to better grip the cord. With this modification, the return wire 27*b* extends directly from the last wire unit 11*c* to the ground of the power circuit and the cord needs to only comprise a single insulated wire.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A light assembly comprising:

a substantially planar frame having a plurality of spokes oriented radially about a central hub, and having a plurality of branches on each of the plurality of spokes, the branches being oriented at an acute angle with respect to the respective spokes, each of the spokes and branches having a front face with a pair of laterally spaced guide channels thereon projecting forwardly; and a string of light units having a cord held in said guide channels so that each branch has a light unit adjacent its outer end which is fixed relative to the frame by said cord.

2. A light display unit according to claim 1 in which said cord has two side-by-side wires positioned one above the other in said guide channels and passing through a wireway in each of said light units.

3. A light display unit according to claim 2 in which each of said branches has a distal portion engaged by a part of the respective light unit.

4. A light display unit according to claim 1 in which said cord loops outwardly from each of said pairs of guide channels to a wireway in a respective one of said light units.

5. A light assembly according to claim 1 in which said branches extend from spokes radiating from a central part of said frame, said spokes also having guide channels receiving the cord to guide the cord between branches.

6. A light assembly according to claim 5 in which each of said spokes has at least four side branches and a tip branch.

7. A light assembly according to claim 5 in which said string of lights includes lights adjacent said central part which are located between guide channels near the inner ends of said spokes.

8. A light assembly according to claim 1 in which said cord passes through respective wireways in said light units, said cord comprising two wires that terminate from opposing ends in the wireway of one of said light units.

9. A light assembly according to claim 8 in which the ends of said wires opposite said one of said light units are connected to terminals of opposite polarity to form at least a portion of a circuit.

10. A one-piece frame for a light display unit comprising:

a hub, spokes radiating integrally from said hub, lateral branches and a tip branch extending respectively from opposite longitudinal edges of each spoke and from the outer end of each spoke, each of said branches having a pair of channels adjacent opposite side edges thereof, and each of said spokes having inner channels therealong between the root ends of said branches, said hub, spokes, and branches having a back side and a front side, channels adjacent the root ends of said spokes, said channels projecting from said front side in a forward direction, and being shaped to hold and guide insulated wires extending between lights located at each branch and also located between said branches adjacent said hub.

11. A frame according to claim 10 in which each of said spokes has two of said lateral branches extending from each of its longitudinal edges.

12. A frame according to claim 10 in which at least one of said inner channels is generally Y-shaped.

13. A frame according to claim 10 in which said back side of the hub, spokes, and branches is flat and occupies a common plane.

14. A frame according to claim 10 in which there are six equally spaced spokes.

15. A frame according to claim 14 in which said hub is hexagonal in shape and said spokes radiate from the apexes of the hexagon.

16. A frame according to claim 10 in which the outer ends of said branches have a flat tip portion.

17. A frame according to claim 10 in which one of said tip branches has a wire entry guide adjacent its outer end.

18. In combination with the frame of claim 10, a light string supported on said frame and having a cord guided by said channels and lights positioned in front of tip portions of said branches.

19. The combination of claim 18 in which said string also has lights positioned between said spokes adjacent to said hub.

20. A light display assembly comprising:

a plurality of light display units each having a plurality of light units, all of said light units being in a circuit comprising wires, each of said display units having a substantially planar frame with spokes oriented radially about a central hub, and branches extending at acute angles from each of the spokes, each of the spokes and branches supporting one of said light units and each having guides for the wires connecting such light units, at least one of said display units being adapted to be suspended from one of the wires in said circuit.

21. A light display assembly according to claim 20 in which said branches in each display unit extend in coplanar relation from spokes radiating from a central hub in such display unit.

22. A light display assembly according to claim 21 in which each spoke has a tip branch at its outer end, and said circuit includes wires for each light display unit which feed to such units along guides on one of said tip branches of each such unit.

23. A light assembly comprising:

a frame having a hub, a plurality of spokes radiating from said hub at root ends, and guide channels adjacent said root ends; and a light string having light units radiating relative to said hub between said spokes and having light units mounted adjacent the outer end of said spokes, and said light string having a cord held in said guide channels and connecting said light units in a series.

24. A light assembly according to claim 23 in which said spokes also each have a pair of laterally spaced guide channels each holding a single width of said cord.

25. A light assembly according to claim 23 in which said hub is hexagonal in shape and has one of said spokes at each of its six vertices.

26. A light assembly according to claim 23 in which said guide channels are generally Y-shaped.

27. A light assembly according to claim 23 in which each of said guide channels has an outwardly radiating portion holding a double width of said cord, and has two oppositely extending wing portions each holding a single width of said cord.

* * * * *